US012060667B2

(12) United States Patent
Callens et al.

(10) Patent No.: US 12,060,667 B2
(45) Date of Patent: Aug. 13, 2024

(54) TUFTING MACHINE AND METHOD FOR REDUCING YARN WASTE

(71) Applicant: Vandewiele NV, Kortrijk (BE)

(72) Inventors: Frank Callens, Oostrozebeke (BE); Kristof Oosterlynck, Ooigem (BE)

(73) Assignee: VANDEWIELE NV, Kortrijk (BE)

( * ) Notice: Subject to any disclaimer, the term of this patent is extended or adjusted under 35 U.S.C. 154(b) by 217 days.

(21) Appl. No.: 17/620,405

(22) PCT Filed: Jun. 18, 2020

(86) PCT No.: PCT/EP2020/067035

§ 371 (c)(1),
(2) Date: Dec. 17, 2021

(87) PCT Pub. No.: WO2020/254534

PCT Pub. Date: Dec. 24, 2020

(65) Prior Publication Data

US 2022/0316120 A1 Oct. 6, 2022

(30) Foreign Application Priority Data

Jun. 20, 2019 (GB) ..... 1908847

(51) Int. Cl.
*D05C 15/34* (2006.01)
*D05C 15/36* (2006.01)

(52) U.S. Cl.
CPC ..... *D05C 15/34* (2013.01); *D05C 15/36* (2013.01)

(58) Field of Classification Search
CPC ..... D05C 15/36; D05C 15/34; D05C 15/22; D05C 15/24; D05C 15/16; D05C 15/20
See application file for complete search history.

(56) References Cited

U.S. PATENT DOCUMENTS 3,338,198 A 8/1967 Short
4,831,948 A * 5/1989 Itoh ..... D05C 15/20 112/80.44

(Continued)

FOREIGN PATENT DOCUMENTS

GB 1324649 7/1973
GB 2354263 A * 3/2001 ..... D05C 15/24

OTHER PUBLICATIONS

The International Search Report issued by the European Patent Office for parent PCT application No. PCT/EP2020/067035 on Oct. 8, 2020; 3 pages.

*Primary Examiner* — Patrick J. Lynch
(74) *Attorney, Agent, or Firm* — Patterson + Sheridan, LLP

(57) ABSTRACT

A method of operating a tufting machine including a sliding needle bar with a plurality of needles, a presser foot mounted slidable with the needle bar, an end yarn feed, a needle selection mechanism, a plurality of loopers, a plurality of knives to cut a loop of yarn on a respective looper, and a dislodge mechanism to selectively dislodge a loop of yarn from the looper before the yarn is cut. The method controls the feed of yarn to the needles and, when a cut end is required, a determination is made whether a predetermined yarn condition is present in the yarn at its cut end and, in response to such a determination, an additional loop of yarn, not required by the pattern data is formed, such that the additional loop of yarn forms a yarn buffer that can be pulled back through the backing medium.

7 Claims, 10 Drawing Sheets

(56) References Cited

U.S. PATENT DOCUMENTS

| | | | | |
|---|---|---|---|---|
| 6,971,326 | B1 * | 12/2005 | Clarke | D05C 15/24 112/80.55 |
| 2004/0253409 | A1 | 12/2004 | Whitten | |
| 2007/0074646 | A1 * | 4/2007 | Modra | D05C 15/34 112/7 |
| 2009/0260554 | A1 * | 10/2009 | Hall | D05C 11/00 112/80.4 |
| 2010/0132601 | A1 * | 6/2010 | Nakagawa | D05C 15/14 112/80.56 |
| 2014/0331906 | A1 * | 11/2014 | Hall | D05C 15/08 112/80.23 |
| 2020/0407902 | A1 * | 12/2020 | Padgett | D05C 15/28 |

* cited by examiner

TUFTING MACHINE AND METHOD FOR REDUCING YARN WASTE

The present invention relates to a tufting machine comprising a needle bar with a plurality of needles, the needle bar being reciprocable in the plane of the needles to form tufts of yarn in a backing medium fed through the machine, the needle bar being slidable transversely to the plane of reciprocation of the needles; a presser foot mounted above the backing medium so as to be slidable with the needle bar, the presser foot comprising a plurality of fingers, with each needle being arranged to pass between a pair of adjacent fingers and into the backing medium; an individual end yarn feed to respectively feed each of a plurality of yarns to a respective needle; a needle selection mechanism to selectively latch a needle to the needle bar when the yarn in that needle is required to form a tuft, so that the needle can move with the needle bar as it reciprocates; a plurality of loopers each configured to pick up a loop of yarn as a respective needle reciprocates; a plurality of knives to cut a loop of yarn on a respective looper; and means associated with each looper to selectively dislodge a loop of yarn from the looper before it is cut.

Such a tufting machine will subsequently be described as "of the kind described".

The tufting machine is a sliding needle bar machine. This means that the needle bar can shift laterally between strokes so that each needle can produce a tuft at a different lateral location as the backing medium progresses.

As will be apparent from the above description, the tufting machine in question is an individual needle control (ICN) machine. In a conventional tufting machine, all of the needles are reciprocated on every stroke of the needle bar and any unwanted yarns are pulled out of the backing material. On an ICN machine, only needles which have a yarn which is required to form a loop at a particular location are latched to the needle bar, so that only the required needles are reciprocated on a particular stroke. Such a tufting machine is produced by the applicant as the ColorTec (RTM) machine.

Further, the yarn feed mechanism is an individual yarn feed mechanism. This means that the feed of yarn to each needle can be individually controlled. This contrasts with other machines where each yarn feed mechanism will feed yarns to a number of needles making it impossible to control the feed of yarn for an individual needle. Such a pattern feed is produced by the Applicant as the Myriad (RTM) yarn feed.

The ability either to cut a loop of yarn on the looper or to dislodge the loop of yarn means that any given stitch can either be formed as a loop pile or a cut pile if it is dislodged from the looper before it is cut. Such an arrangement is well-known in the art is referred to as a level cut looper (LCL) which allows for the yarn to be collectively dislodged from the looper before it is cut.

A tufting machine with all of these features provides the greatest flexibility in the field of tufting machines as the ability to select individual needles and to individually control the yarn as the needle bar is reciprocated across the tufting machine allows for a high level of flexibility in the patterns to be formed. Further, the machine is capable of producing both loop and cut pile yarns again providing further flexibility.

A problem which arises in a machine of the kind described occurs when the pattern requires a change from a first yarn to a second yarn, usually in the form a change from a first to a second colour (but possibly also a change of weight or texture of the yarn).

When a change of yarn is required and that same yarn is not required in the pattern for some time, the end of yarn is cut by the knife. If this is not done, the non-required yarn will trail along the rear face of the backing medium. This is a waste of yarn and the trailing yarns interfere with the required yarns.

Because the machine uses a sliding needle bar, as the needle bar reciprocates laterally, this pulls the yarn with it in a lateral direction even though the presser foot follows the sliding movement of the needle bar. The surface of the underside of the presser foot presses the yarn against the backing medium. Due to the lateral movement, and this pressing the last cut end can be pulled out of the backing medium and stay uncontrolled somewhere under the presser food where it can interfere with yarns being formed by an adjacent needle.

In practice, this lateral shift is accounted for by overfeeding the yarn to provide yarn compensation to compensate for the lateral shift by feeding additional yarn to the cut end. However, although this helps to some extent, the fact that the cut end is not reliably held under the presser foot means that it may behave in an unpredictable manner. Moreover, the pressure surface of the presser foot can damage the backing stitch if the pressure is too high. On the other hand, reducing the pressure exerted by the surface increases the risk that the cut end can lift from the underlying support which can lead to problems not only for the individual yarn being tufted, but also for the adjacent tuft. This yarn can come loose from the needle or can be stitched through by adjacent needles.

The present invention aims at addressing the above problem.

The present invention has the capability to determine that, following formation of the cut end, certain pattern conditions are present, and in response to this, to form an additional loop of yarn in the backing medium. The purpose of forming this additional yarn could be to provide an anchor point to the cut end of yarn.

In this situation, the method preferably further comprises controlling the feed of a first yarn to a first needle and a second yarn to a second needle based on pattern data, such that when the pattern data requires a transition from the first yarn to the second yarn leaving a cut end of the first yarn, the predetermined yarn condition comprising a determination that the first yarn is not required in the pattern for more than a predetermined number of tufts, the method comprises forming an additional loop of yarn of the first colour after the cut end, the additional loop of yarn not being required by the pattern data, and being formed adjacent to the first tuft of the second yarn, and pulling the additional loop of yarn through the backing medium as the backing advances.

By forming an additional loop of yarn after the final cut end, the present invention effectively creates a small buffer of yarn which is anchored to the backing medium. This ensures that the yarn remains under the presser foot while further tufts of the second yarn are formed allowing this to be done in a much more controlled manner. As the backing medium advances, the additional loop is pulled low and preferably out of the backing medium so that it is not visible in pattern in the region of the second yarn.

In an alternative situation, the predetermined yarn condition could be at the start of the formation of a new carpet where a number of cut piles are formed, but where there may be residual tension in the yarn. Under such circumstance, the predetermined yarn condition is that the cut end is formed in a region at the start of the carpet before the carpet pattern is formed. In this case, additional loops will be formed for all yarns.

By providing a number of cut piles followed by additional loops, anchoring all the yarns to the backing medium, optimal starting conditions for the carpet can be guaranteed. Therefore no residual yarn tensions need to be taken into account so the backing stitch calculations are simplified.

To enhance this effect more than one additional loop of each yarn, e.g. two additional loops of each yarn, can be placed immediately after each other.

The calculations may be carried out on the tufting machine, however, preferably the method further comprises the determination of the predetermined yarn condition and the formation of the additional loop to be carried out by tuft production software which determines the yarn feed data based on the determination of the requirement from an additional loop and on the pattern data and converts this into a machine readable format readable by the tufting machine.

The calculation of the data for forming the tufts of the present invention including the additional loop may be determined by tuft production software, for example the Tuftlink® or TexConnect® system provided by the Applicant. Once provided with pattern data, it can be configured to recognise a transition from a first yarn to second yarn where the first yarn has a cut end and where the first yarn is not required by the pattern data for a number of stitches exceeding a predetermined amount, the software then being configured to calculate that the additional loop of yarn is required, and to convert the yarn feed data based on a combination of pattern data and additional loops calculated in this manner into a machine readable format readable by the tufting machine.

An example of a tufting machine and method will now be described with reference to the accompanying drawings, in which.

Figure 1:
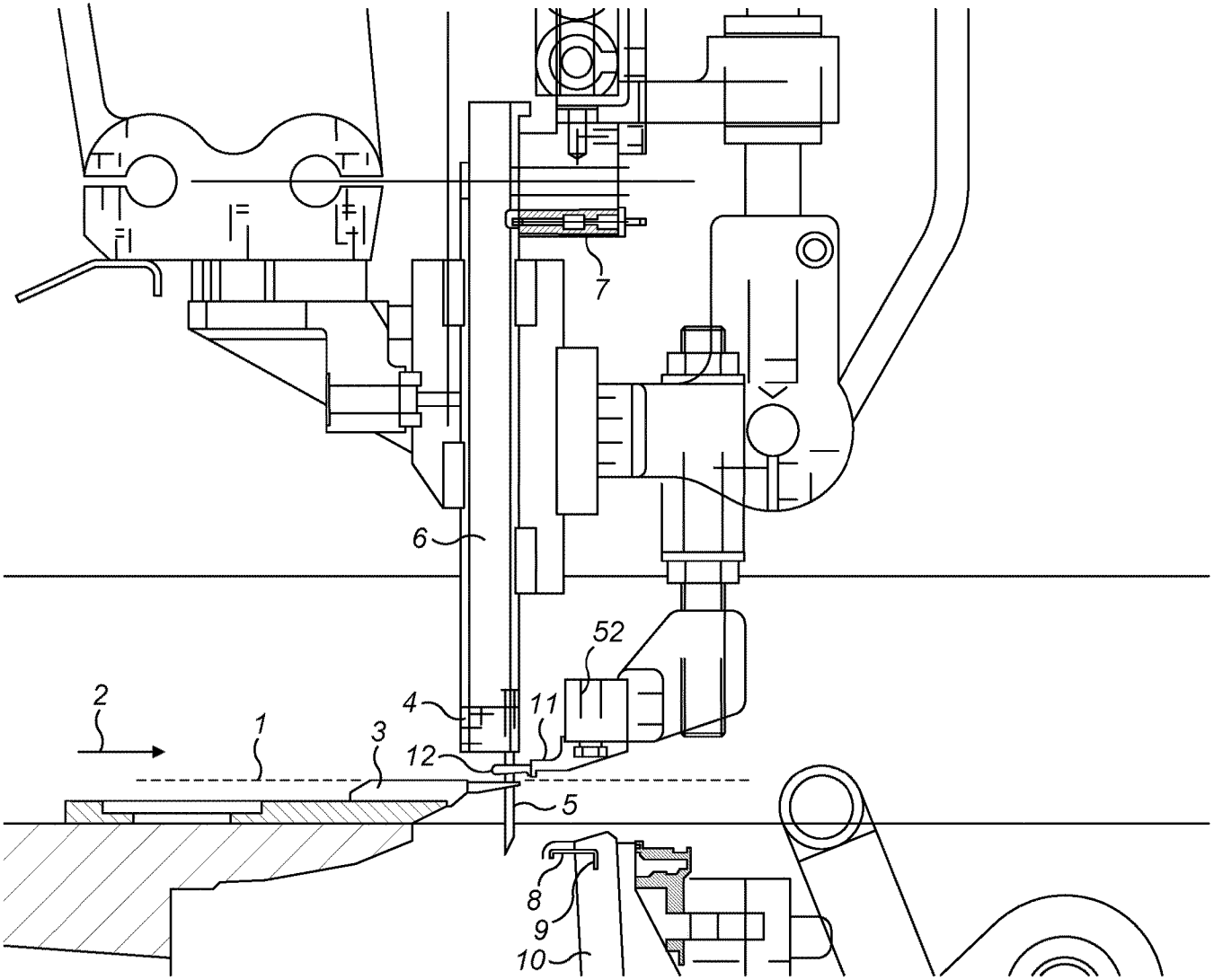
FIG. 1 is a cross-sectional side view of the tufting machine of the present invention.

The tufting machine shown in FIG. 1 is, in almost every respect, a known individual needle control (ICN) machine. As this is largely conventional, the main components will be described briefly here.

The backing medium 1 depicted schematically as a dashed line in FIG. 1 is fed through the tufting machine in a feed direction depicted by arrow 2 and is supported in the tufting position by a bed plate 3. A needle bar 4 supports a line of needles 5 (the line extending in the direction perpendicular to the plane of FIG. 1). Each needle 5 is supported on a needle support 6. Each needle support 6 has an associated latch 7 such that, if the needle 5 is required to be reciprocated in a particular stroke, the needle 5 can be selectively latched to the needle bar 4 so that it will penetrate the backing medium 1 to form a loop of yarn. Such a making is well-known in the art as an individual needle control (ICN) machine.

Beneath the backing medium 1 is a looper 8 associated with each needle 5. The loopers 8 will rock forwards to pick up a loop of yarn formed by the needle 5. In this example, the loopers are preferably level cut loopers (LCL), these have a latching mechanism which is configured either to ensure that the loop of yarn slips off of the looper 8 or alternatively to ensure that it is retained on the looper 8 such that it slides back to a throat 9 of the looper and is cut by a respective knife 10 in order to form a cut pile tuft. This mechanism is therefore capable of selectively forming loop or cut pile tufts. Further details of a level cut looper are disclosed, for example, in GB 2367305 or GB 2354263.

Figure 4:
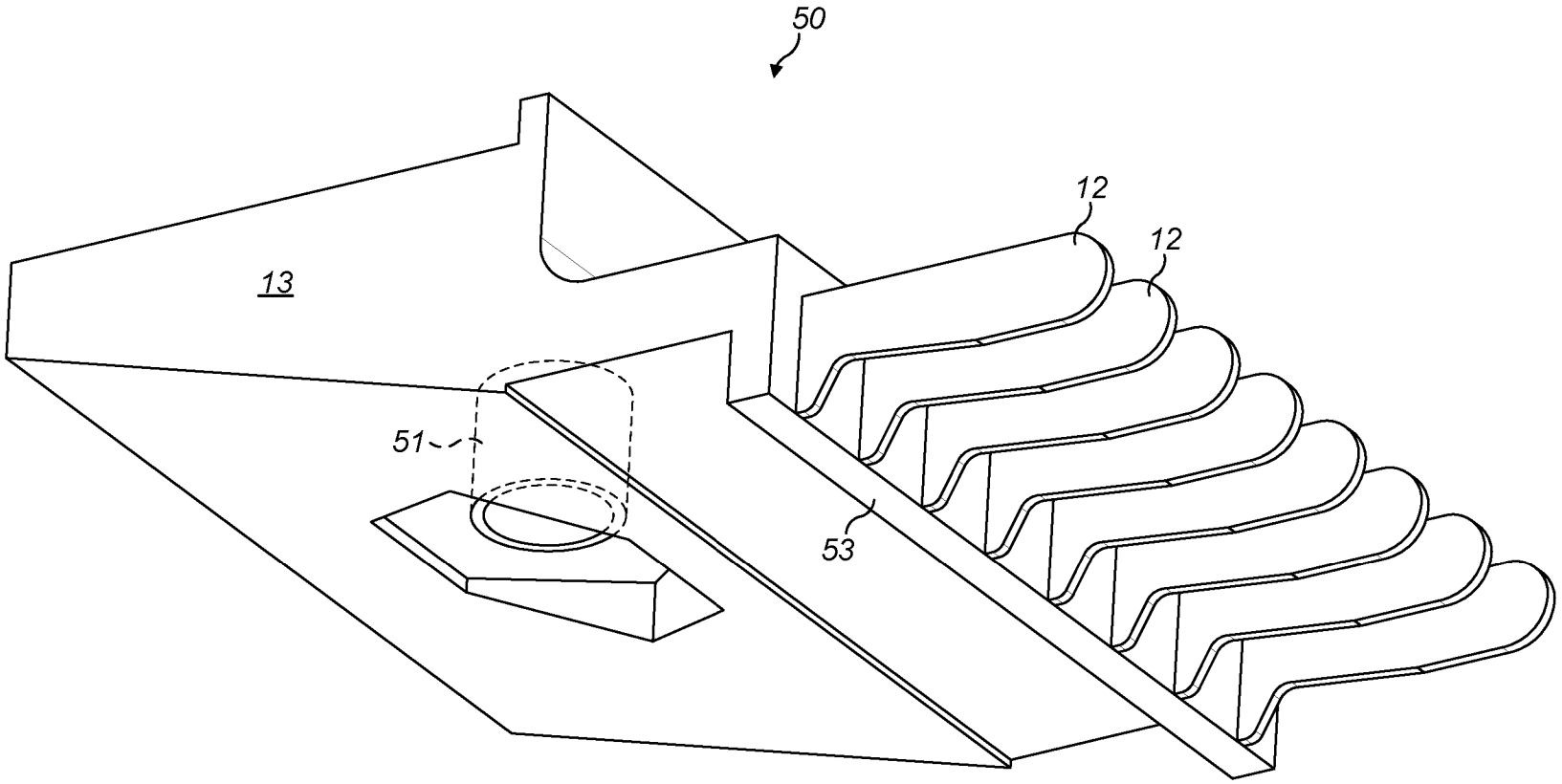
FIG. 4 is a perspective view of a presser foot module according to a second aspect of the present invention.

In order to support the backing medium 1 as the needles 5 are pulled through it in the upwards direction in FIG. 1, a presser foot 11 is provided. This is mounted so as to shift laterally to following the movement of the needle bar 4. The presser foot comprises a plurality of fingers 12 and a mounting body 13. The distal ends of the fingers 12 may be supported by the presser foot bar 14 (see FIG. 2A-F) in a conventional manner, or may be constructed in accordance with the second aspect of the present invention as shown in FIG. 4 and described later.

Other than this potential adaptation of the presser foot 11, all of the features shown in FIG. 1 are conventional features of an ICN machine.

The needles 5 are threaded up with different types of yarn. These are usually different colours with the number of colours required for a particular pattern being arranged in a repeating sequence across the machine.

In use, the tufting machine operates in accordance with pattern data in order create a desired pattern. The needle bar reciprocates laterally with respect to the feed direction 2 which selectively brings the number of needles into alignment at a particular stitch location. When the pattern data determines that a colour required for the pattern in this area is required, the latch 7 is operated latching the needle to the needle bar 4 such that this needle can create a tuft of yarn at that location.

In many carpet patterns, there will be a relatively large block of a particular colour followed by a block of a different colour. As a result of this, it is common that a particular needle will not be required to produce a tuft for a number of strokes. The yarn at that needle could simply be left such that it trails across the underside of the backing medium. Indeed, this is what happens when a yarn is not required only for a relatively small number of stitches. However if yarn is not required for a significant number of stiches, this is wasteful as the yarn is used up even though it is not required in the pattern, as well as creating a potential hazard on the rear face of the backing medium as it can become tangled with adjacent yarns.

Thus, any yarn which is not required for a significant period is cut by the knife 10 and the needle with this cut end of yarn will retract until it is required again in the pattern.

The present invention concerns the manner in which the tufting machine deals with this transition. This is illustrated in FIGS. 2A to 2G as described below.

FIGS. 2A to 2G progressively depict seven separate tufts of yarn which are formed during a colour transition from a first yarn 20 of a first colour depicted in dark shading in FIGS. 2A to G to a second yarn of a second colour 21 depicted in light shading in FIGS. 2A to G.

Further, FIGS. 2A to G are from the opposite side from FIG. 1, such that the backing 1 now moves in the opposite direction in these figures as depicted by the arrow 2. The plane of the cross section in FIGS. 2A to 2G remains the same throughout. Therefore, all of the gauge parts below the backing medium 1 are the same in all figures. On the other hand, because the needles 5 and presser foot 11 are shifted laterally between tufts, the needles 5 and fingers 12 of the presser foot may vary from one drawing to the next as described below.

Figure 2A:
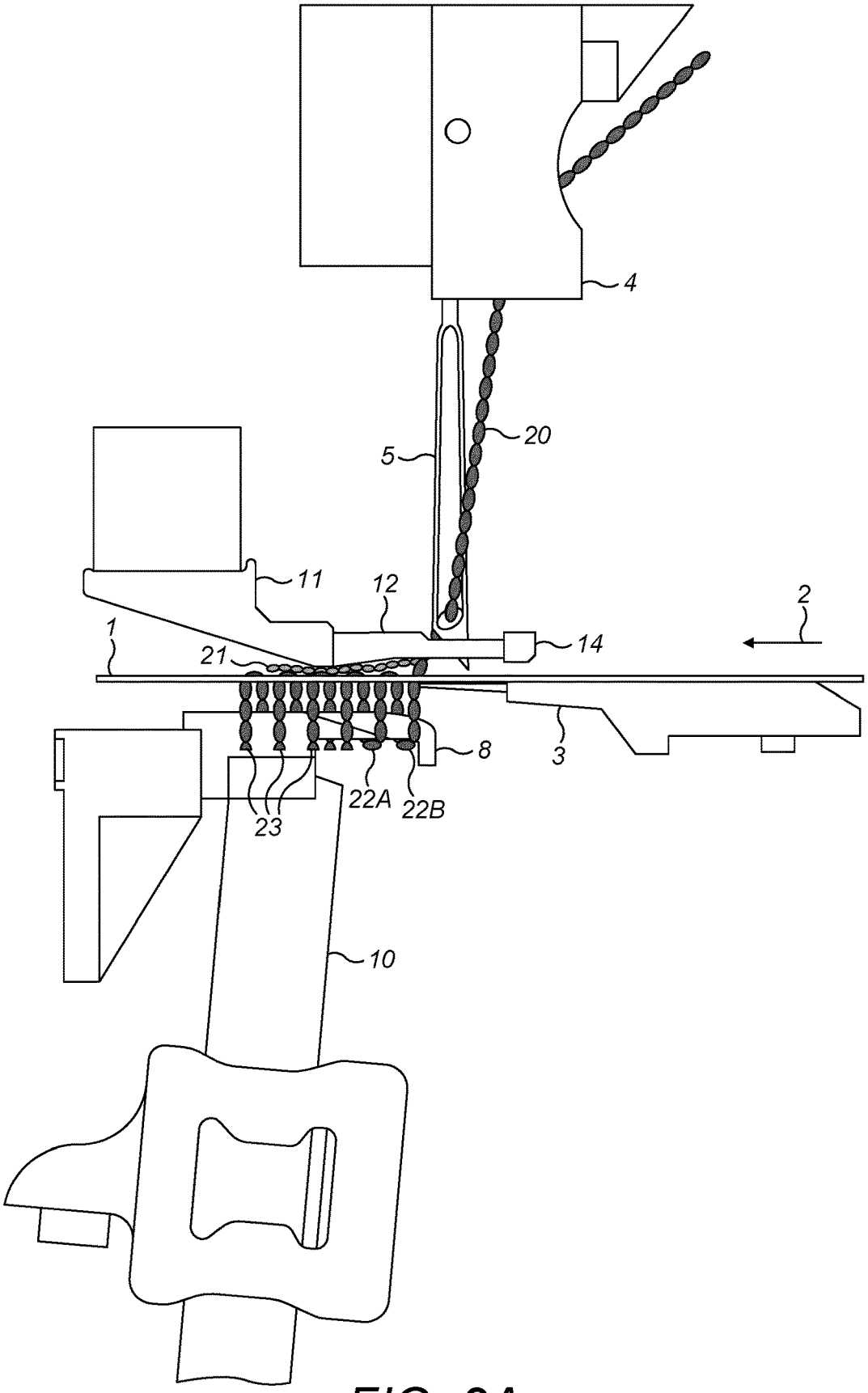
FIGS. 2A to 2G are schematic side views from the opposite side from FIG. 1 showing just the components of the tufting machine in the vicinity of the backing medium illustrating a succession of tufting cycles demonstrating the transition from one yarn to another in accordance with the invention.

As shown in FIG. 2A, at the location of interest, a number of tufts 22 of the first colour have already been formed on the looper 8. The earliest formed tufts 23 have been cut by the knife 10 in order form cut pile. The tuft 22A which is second to the right on the looper 8 as shown in FIG. 2A is the last tuft of the first yarn 20 which is required by the pattern data. The right most tuft 22B is an additional loop of yarn which is not required by the pattern data, but is formed for the reasons described below. At this point, the second yarn 21 trails across the rear face of the backing medium 1 extends through the eye of a needle 5' (not visible in this figure as it is out of the plane of FIG. 2A).

Figure 2B:
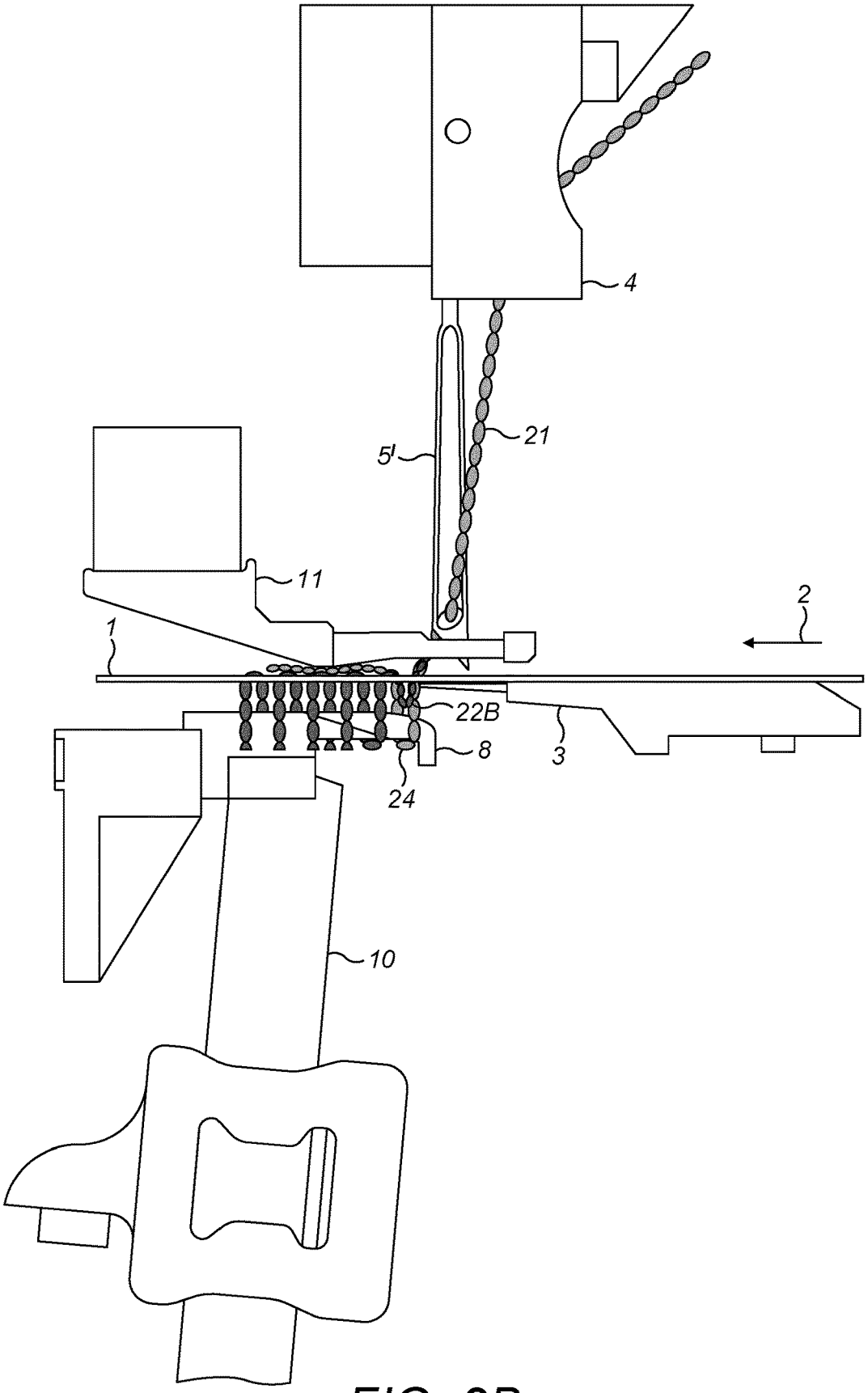

As shown in FIG. 2B the needle 5' which has now been moved laterally into the plane of the figure has the second yarn 21. All of the subsequent FIGS. 2C to 2G show the needle 5' with the second colour 21. This can either be achieved by not shifting the needle bar from the position shown in FIG. 2B. Alternatively, the needle bar may be shifted to the extent that a different needle with the second colour 21 is in this position or the first needle with the second colour 21 has returned to this position.

FIG. 2B shows the next stroke of the cycle. In this position, the needle bar 4 has shifted by one or more pitches so that the needle 5' which the second yarn 21 is now aligned with the looper 8. During this time, the backing medium 1 has not advanced, or has advanced by a fraction of a pitch so that the loop 24 of the second yarn 21 is formed at essentially the same stitch location as the additional loop 22B.

When the additional loop 22B is formed, it does not pass the latch on the looper so that the looper 8 rocks back, the loop 22B is not retained on the looper 8. This is a well-known operation of a LCL device.

The first loop 24 of the second yarn 21 is, however, retained on the looper as shown.

As a result of formation of the additional loop 22B, the first yarn 20 is maintained beneath the presser foot 11 while further stitches are required for the pattern are formed.

Figure 2C:
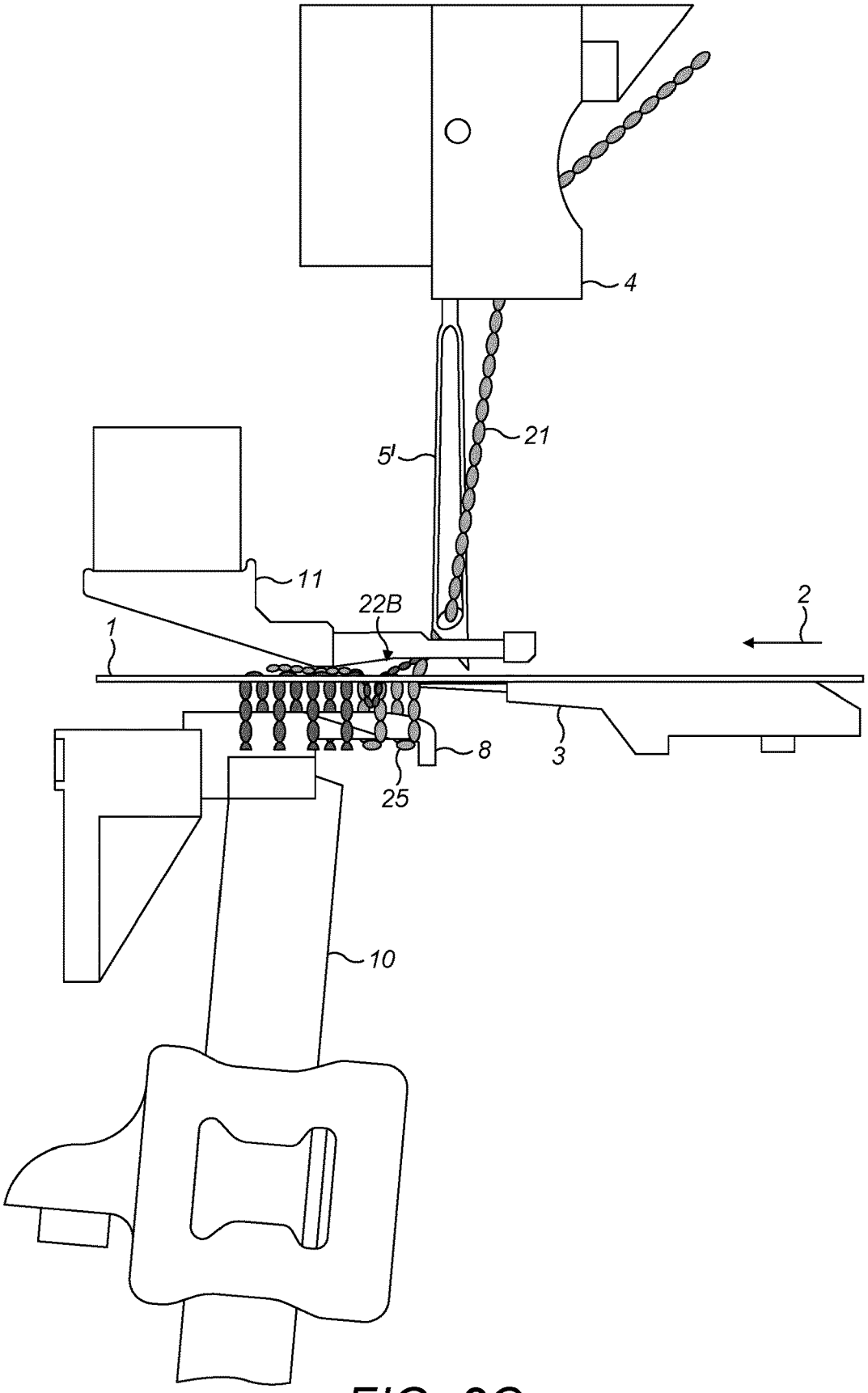

The yarn feed controller for the first yarn 21 is controlled to underfeed the yarn to the additional loop 22B so that, as the carpet moves onto the third stitch shown in FIG. 2C, additional loop 22B is pulled back through the backing medium 1, as a second loop of the second colour 25 is tufted. As is apparent from FIG. 2C, the loops 24, 25 of the second yarn 21 are retained on the looper 8.

Figure 2D:
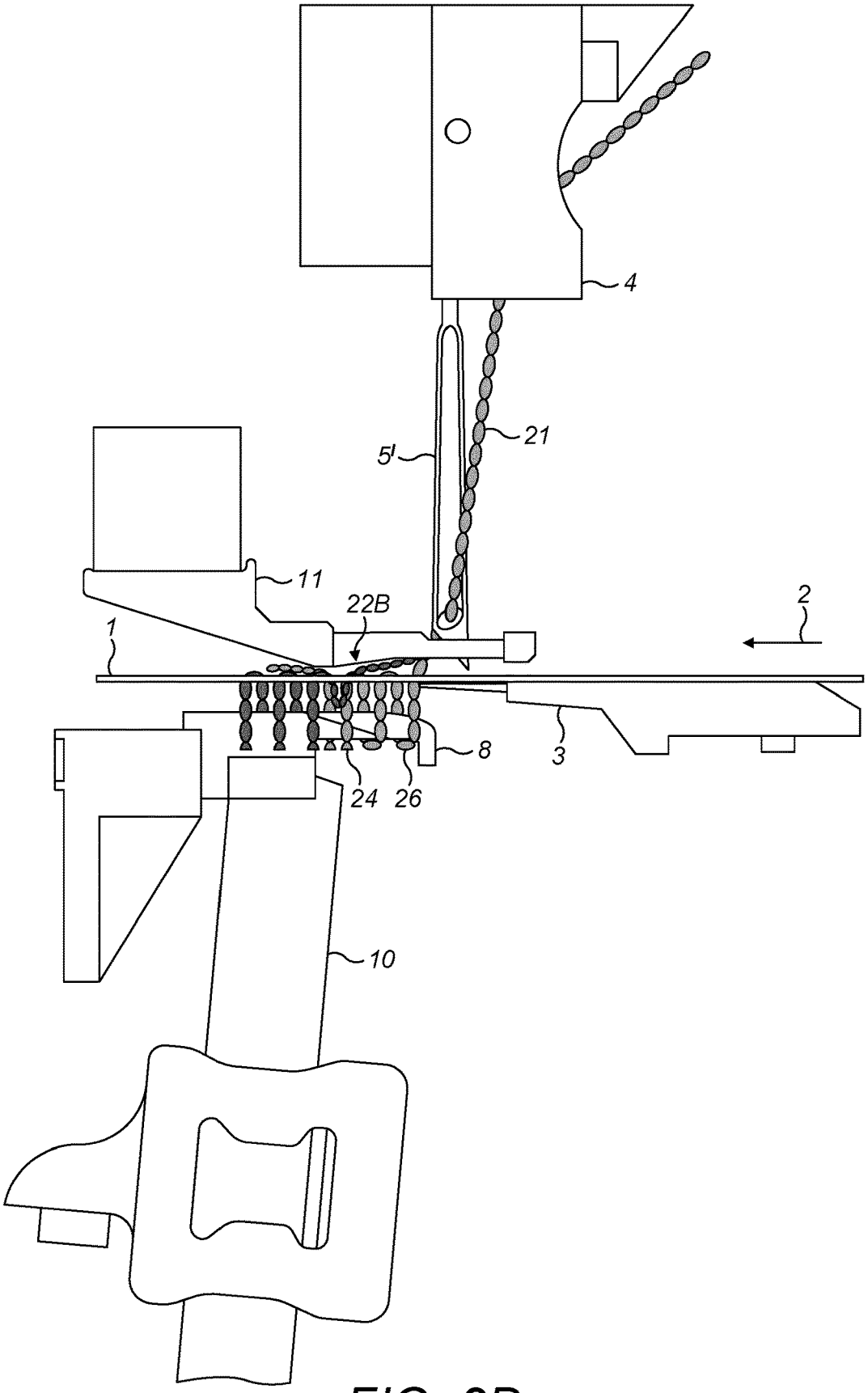
Figure 2E:
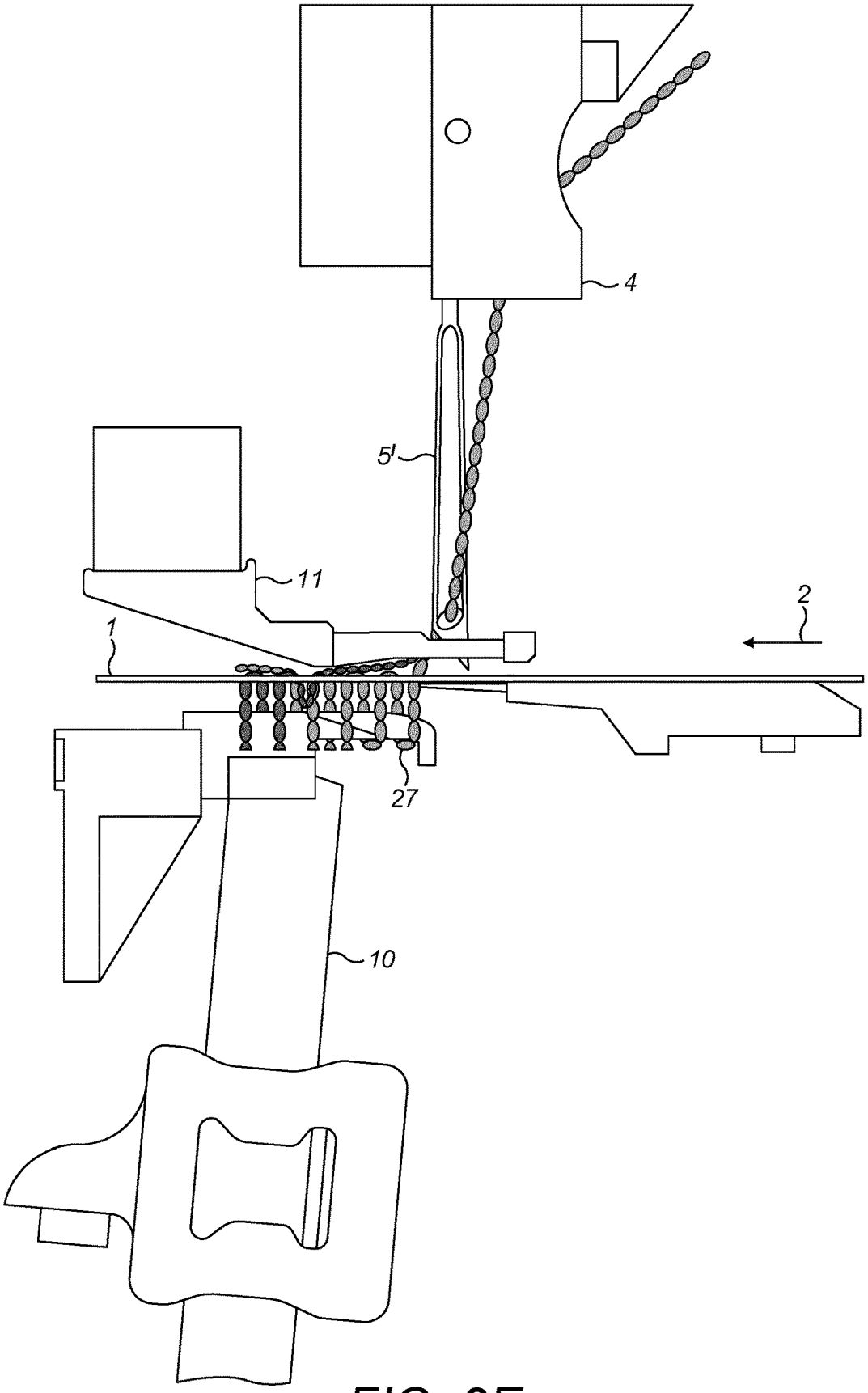
Figure 2F:
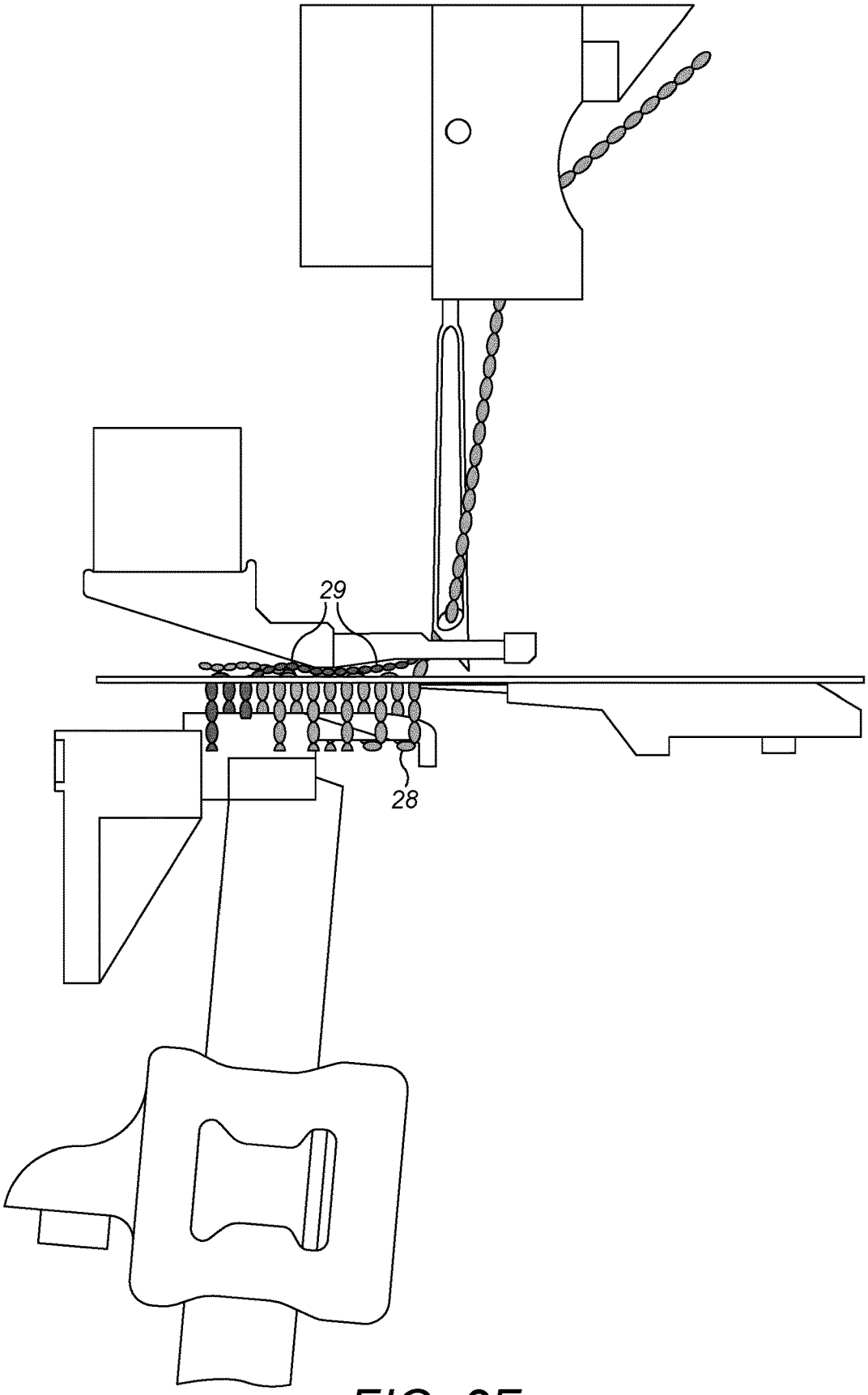

In the next tuft shown in FIG. 2D, a third loop 26 of the second yarn 21 is formed while the first loop 24 of the second yarn reaches the knife 10 and is cut. As the backing medium 1 continues to advance, the additional loop 22B continues to be pulled out of backing medium 1. By the time the fourth 27 and fifth 28 loops of the second yarn have been formed as shown in FIGS. 2E and 2F, the additional loop has been fully pulled out of the backing medium 1 as depicted at 29 in FIG. 2F.

Figure 2G:
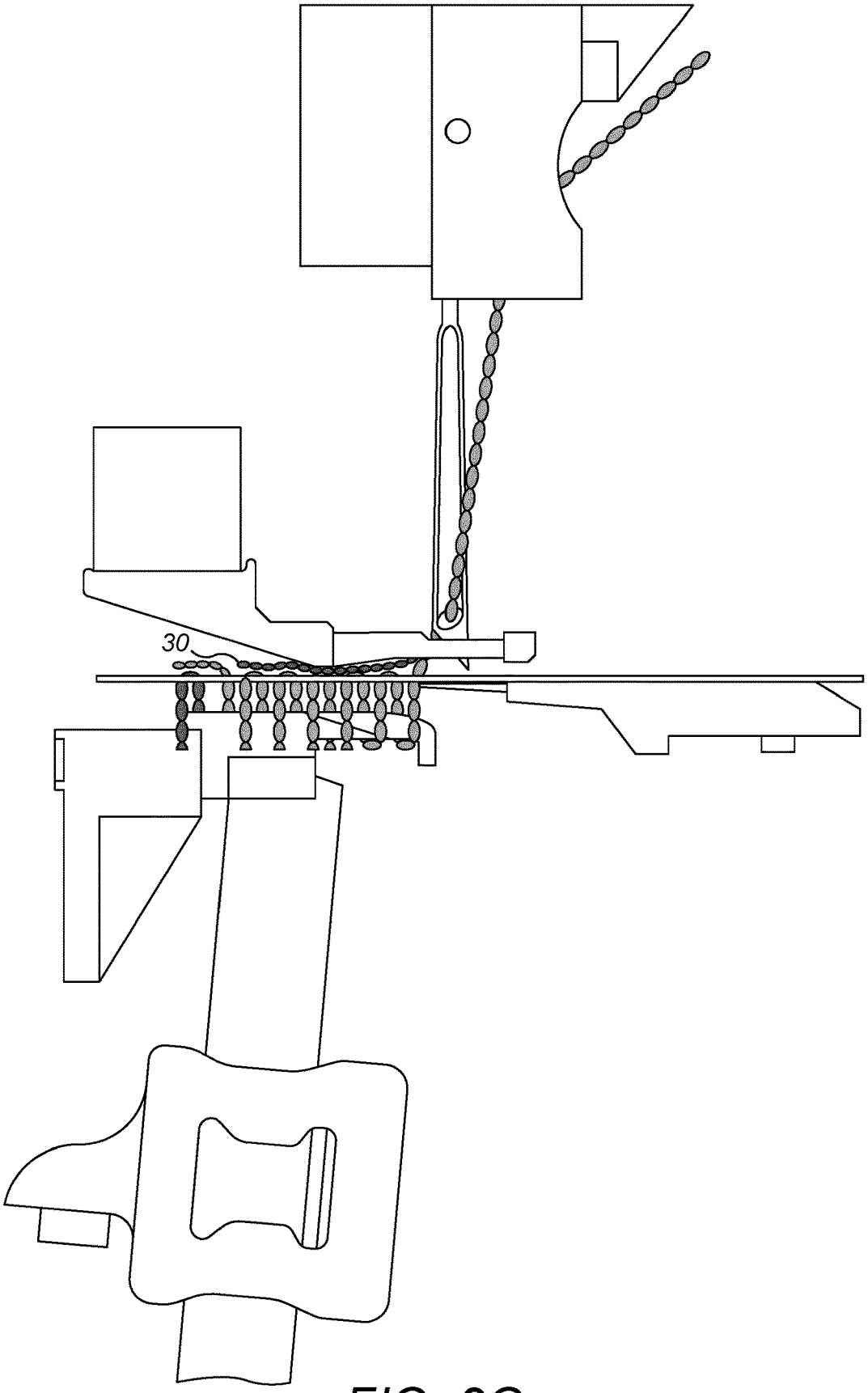

Finally, as shown in FIG. 2G, the cut end 29 of the tuft adjacent to the additional loop 22B is pulled out of the backing medium 1 so the cut end 29 forms a loose end of the first yarn 20. The needle 5 with this yarn remains retracted with this loose end until it is required again for the pattern.

As will be appreciated from a consideration of FIGS. 2C to 2G, the first yarn 20 is anchored to the backing medium 1, all of the time at the first yarn 20 is under the presser foot 11. This prevents the yarn 21 from being laterally displaced at this time which can create an unpredictable tension within the yarn as well as potentially interfering with other yarns. Further, although the yarn tension is controlled by the yarn feed, they are likely to residual tensions in the yarn during the tufting process. If the yarn is cut without forming the additional loop 22B, these tensions can cause variations in the pile height in this region. Additional loop 22B therefore provides an additional buffer which can absorb the effects of any such residual tension in the yarn.

Figure 3:
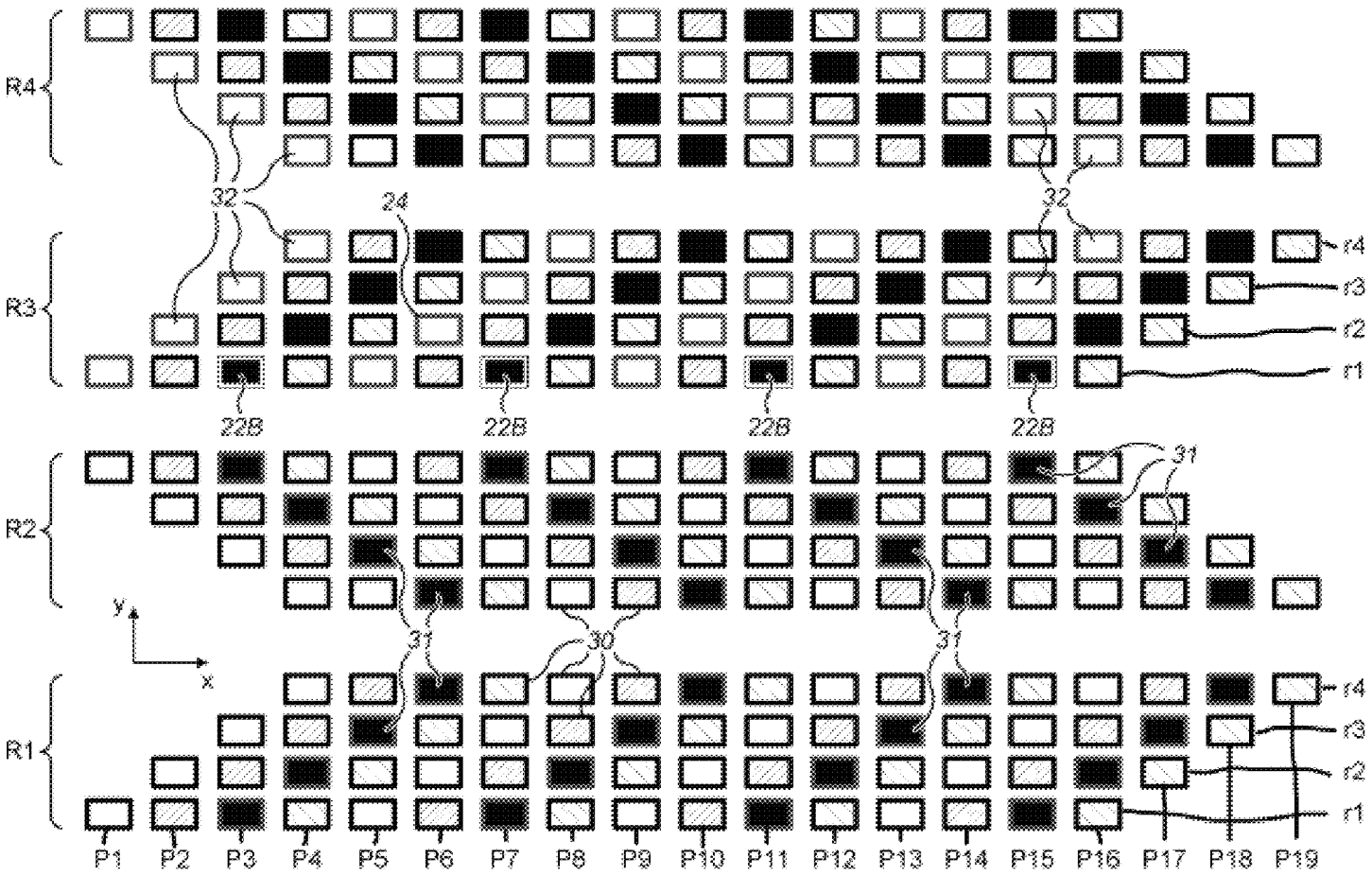
FIG. 3 is a schematic diagram showing a number of stitch locations showing the transmission from a first yarn to a second yarn according to the first example of the present invention.

While the operation of tufting machine has been described with relation to a single position of a tufting machine, reference is now made to FIG. 3 which provides an alternative explanation of this process.

FIG. 3 provides a schematic diagram showing the placement of tufts for one particular example of the present invention. The notation used in the FIG. 3 is as follows.

The figure depicts four rows of tufts R1-R4. Each of these rows corresponds to a single row in the pattern. For the purposes of illustration, each row is broken down into four sub-rows r1-r4. Each of the sub-rows represents the needle bar at a particular position. The needle bar is provided with sixteen needles corresponding to P1-P16, the needle bar is threaded with four colours depicted by the different shadings at locations P1-P4 this is repeated four times across the needle bar at P5-P8, P9-P12 and P13-P16. In practice, these sixteen needles will be repeated several times across the tufting machine.

The carpet is tufted from the bottom to the top in FIG. 3. The axis X is the direction in which the lateral needle bar is shifted, while the axis Y represents the direction in which the backing is moved through the tufting machine and corresponds to the direction depicted with reference numeral 2 in FIGS. 1 and 2.

All of the stitches which are surrounded by a dark solid border (see for example, reference numeral 30) represent colours which are not required in the pattern. Thus, at these locations, the needle support 6 for all the needles 5 above these locations is not latched to the needle bar 4 such that, as the needle bar is reciprocated in this sub-row a tuft of these colours are not formed.

In the pattern being created in FIG. 3, the pattern data calls for two rows (R1 and R2) be tufted with black yarn and a representative sample of these yarns are depicted by reference numeral 31. The second two rows (R3 and R4) are rows in which the pattern data calls for a white yarn and a representative sample of these are depicted by reference numeral 32.

The sub-rows are r1-r4 are depicted as being spaced in the Y direction for clarity of explanation. However, in practice, these four rows will be formed at essentially the same position in the Y direction either because the backing medium is stopped as the needle bar is reciprocated to create these rows, or because the backing medium is moving slowly at this time.

In the first sub-row r1 of row R1, a black tuft will be formed at positions P3, P7, P11 and P15. The needle for the black yarn is selected while the remaining colours at all other locations are not selected such that only the black tufts are formed. In the second sub row (r2) the needle bar has shifted one position to the right and the above process is repeated such that black stitches are formed at positions P4, P8, P12 and P16. This process is repeated a further two times to create sub rows r3 and r4 at which point all of the first row R1 in the pattern is filled in with black tufts 31. The needle bar is reversed and the above process is repeated to form the second row R2 to create a second row of black tufts.

For the second two rows R3 and R4, the same process is repeated this time latching just the needles with the white yarn 32 first in sub-row r1 in row R3 formed at locations P1, P5, P9 and P13. The white tufts then shift from one position to the right to form the next sub-row until R3 is completed at which point the needle bar is reversed to form row R4.

The present invention requires formation of the additional tuft 22B as described above in relation to FIGS. 2A to 2G. This is shown in sub-row r1 of row R3 which effectively causes a black tuft 22B to be formed in a row in which the pattern calls for white tufts 32. Thus, in sub-row r1 of row R3, needles 5 corresponding to both black yarn 31 and white yarn 32 are latched to the needle bar 4 such that both stitches are formed in this row.

With reference to just the column designated P7 in FIG. 3 by way of example, the black loop 31 which is formed in the reciprocation of the needle bar in sub-row r4 of R2 corresponds to the stitch 22A of FIG. 2A. The black loop which is formed in the reciprocation of the needle bar in sub-row r1 of R3 corresponds to the formation of the additional stitch 22B shown in FIG. 2A. In the sub-row r2 of R3, no stitch is formed so this stroke is not depicted in a sequence of figure of FIG. 2A to 2G. However, in sub-row r3, a white stitch 32 is formed and this corresponds to the first loop of second yarn 24 as shown FIG. 2B.

As explained with reference to FIGS. 2A-2G, although a black tuft 31 is formed in addition to the white yarn 32 in region where the pattern calls for white yarn, this tuft is not visible in the finished article as it is pulled out as previously described.

As described above, the carpet being tufted is a cut pile carpet. However, the technique can equally be applied to a loop pile carpet. In this situation, with reference to FIGS. 2A and 3, all of the rows of colour up to and including R1 in FIG. 3 are tufted as loop pile. However, in row r4 of R2, the tufts 22A are formed as cut pile to create a loose end 29 (FIG. 2G) which can be pulled out along with of the additional loop 22B as described above.

A further application of this technique relates to the starting of a new carpet. When doing this, the tension in the yarns may be different from the desired tension. As the tension may vary depending on whether the yarn was used at the end of the previous carpet. Variations in tension can also cause the backing stitch compensation to be calculated inaccurately. In order to "reset" the tension to ensure that it starts at the desired level, a technique similar to that described above can be performed. Firstly, all of the needles on the needle bar are selected such that all colours are tufted to form a number of rows of normal cut pile. Following this, one or more additional loops 22B as described above may be formed at each of the needles. These additional loops effectively provide a buffer of yarn allowing the loops to be pulled low or out of the backing material in order to relieve any additional tension. If the additional loops are not fully pulled out of the backing material during this process, they can be cut away when finishing the carpet.

As mentioned above, the presser foot may have an unconventional design as shown in FIG. 4. This is the subject of co-pending application (Agent's Ref. P207640GB00). This shows one module 50 of the presser foot 11. As described above, this has a mounting body 13 from which a plurality of fingers 12 project in a direction opposite to the direction 2 in which the backing medium 1 is fed through the tufting machine. The body 13 is provided with a mounting hole 51 by which the presser foot module 50 is mounted to a presser foot bar 52 (FIG. 1) which is mounted to slide laterally together with the needle bar, but does not reciprocate with the needle bar in the direction of reciprocation of the needles. Instead, it remains in the position shown in FIG. 1 immediately above the backing medium 1.

The module 50 has three unconventional features. Firstly, in a conventional presser foot module for an ICN machine, a bar extends across the distal end of the fingers 12. In FIG. 4, no such bar is present such that there is an open gap at the distal end of the fingers 12. This improves the rethreading of the tufting machine as, when passing a yarn through the presser foot, this can be done by moving the yarn laterally between two fingers 12, rather than having to thread a cut end from top to bottom as previously. The replacement of a module is also easier.

The second modification in FIG. 4 is the presence of a downwardly depending lip 53 which extends across the module 50 in a downward direction such that, in use, only this lip 53 engage with the backing medium 1 as shown in FIG. 1.

As a third modification, the fingers 12 have been shortened. In particular, the ratio of the maximum length of a finger to the pitch of the fingers has been reduced from 4.3 to less than 4, more preferably less than 3.5 and most preferably less than 3. This saves material and reduces weight. Now that the bar is no longer required, the size of the opening between adjacent fingers is no longer an issue in the threading operation.

In use, the yarns extend down between adjacent fingers and the portions of the yarn which end up on the rear surface of the backing medium 1 then slide under the module body 13. By providing the lip 53, rather than the yarn engaging with a long portion of the module 13, they only engage under the lip leading to a reduced frictional force between the presser foot and the yarn. Also, as the lip 53 represents a single line of contact between the presser foot and the yarn, it is easier to control the amount of pressure on the yarn. Control of this pressure is important and it requires a balance between creating a pressure which is high enough to ensure that the loose ends of yarn stay under the presser foot, but which is not high enough generate undue friction on the yarns.

The invention claimed is:

1. A method of operating a tufting machine comprising:

providing a needle bar with a plurality of needles, the needle bar being reciprocable in a plane of the needles to form tufts of yarn in a backing medium fed through the machine, the needle bar being slidable transversely to the plane;

providing a presser foot mounted above the backing medium so as to be slidable with the needle bar, the presser foot comprising a shift plurality of fingers, with each needle being arranged to pass between a pair of adjacent fingers and into the backing medium;

providing an individual end yarn feed to respectively feed each of a plurality of yarns to a respective needle;

providing a needle selection mechanism to selectively latch a needle to the needle bar when the yarn in that needle is required to form a tuft, so that the needle can move with the needle bar as it reciprocates;

providing a plurality of loopers each configured to pick up a loop of yarn as a respective needle reciprocates;

providing a plurality of knives to cut a loop of yarn on a respective looper;

and providing means associated with each looper to selectively dislodge a loop of yarn from the looper before it is cut;

the method further comprising controlling the feed of yarn to the needles such that, when a cut end is required, a determination is made that a predetermined yarn condition is present in the yarn at its cut end and, in response to the predetermined yarn condition being present, an additional loop of yarn, not required by pattern data is formed, such that the additional loop of yarn forms a yarn buffer that can be pulled back through the backing medium.

2. The method of operating the tufting machine according to claim 1, comprising controlling the feed of a first yarn to a first needle and a second yarn to a second needle based on pattern data, such that when the pattern data requires a transition from the first yarn to the second yarn leaving a cut end of the first yarn, the predetermined yarn condition comprises a determination that the first yarn is not required in the pattern for more than a predetermined number of tufts, the method further comprises, in response to the predetermined yarn condition being present, forming the additional loop of yarn of a first color after the cut end of the first yarn, the additional loop of yarn not being required by the pattern data, and being formed adjacent to the first tuft of the second yarn, and pulling the additional loop of yarn through the backing medium as the backing advances.

3. The method of operating the tufting machine according to claim 1, wherein the predetermined yarn condition is that the cut end is formed in a region at a start of a carpet before a carpet pattern is formed.

4. The method of operating the tufting machine according to claim 1, wherein the determination of the predetermined yarn condition and the formation of the additional loop is carried out by tuft production software which determines yarn feed data based on a determination of a requirement for the additional loop and based on the pattern data and converts this yarn feed data into a machine readable format readable by the tufting machine.

5. A tufting machine comprising:

a needle bar with a plurality of needles, the needle bar being reciprocable in a plane of the needles to form tufts of yarn in a backing medium fed through the machine, the needle bar being slidable transversely to the plane;

a presser foot mounted above the backing medium so as to be slidable with the needle bar, the presser foot comprising a plurality of fingers, with each needle being arranged to pass between a pair of adjacent fingers and into the backing medium;

an individual end yarn feed to respectively feed each of a plurality of yarns to a respective needle;

a needle selection mechanism to selectively latch a needle to the needle bar when the yarn in that needle is required to form a tuft, so that the needle can move with the needle bar as it reciprocates;

a plurality of loopers each configured to pick up a loop of yarn as a respective needle reciprocates;

a plurality of knives to cut a loop of yarn on a respective looper;

and means associated with each looper to selectively dislodge a loop of yarn from the looper before it is cut;

a yarn controller controlling the feed of yarn to the needles, such that, when a cut end is formed from a yarn, the controller is configured to form an additional loop of the yarn after the cut end, the additional loop of yarn not being required by pattern data but being formed in response to a determination that a predetermined yarn condition is present in the yarn at its cut end.

6. The tufting machine according to claim 5, wherein the yarn controller controls the feed of a first yarn to a first needle and a second yarn to a second needle based on the pattern data, such that;

the predetermined yarn condition is that the pattern data requires a transition from the first yarn to the second yarn leaving a cut end of the first yarn, and that first yarn is not required for a predetermined number of stitches, such that after the cut end of the first yarn, the additional loop of yarn is formed, not being required by the pattern data, and being formed adjacent to the first tuft of the second yarn, and being such that the additional loop of yarn is pulled through the backing medium as the backing advances.

7. The tufting machine according to claim 5, wherein the predetermined yarn condition is that the cut end is formed in a region at a start of a carpet before a carpet pattern is formed.

* * * * *